US005523766A

United States Patent [19]

Erceg

[11] Patent Number: 5,523,766

[45] Date of Patent: Jun. 4, 1996

[54] APPARATUS FOR MAINTAINING ANTENNA POLARIZATION IN PORTABLE COMMUNICATION DEVICES

[75] Inventor: Vinko Erceg, Roselle Park, N.J.

[73] Assignee: AT&T Corp., Murray Hill, N.J.

[21] Appl. No.: 148,740

[22] Filed: Nov. 5, 1993

[51] Int. Cl.[6] ..... H01Q 1/24

[52] U.S. Cl. ..... 343/702; 343/882; 343/900

[58] Field of Search ..... 343/702, 900, 343/880, 882, 888, 878; H01Q 1/24, 1/18

[56] References Cited

U.S. PATENT DOCUMENTS

| | | | |
|---|---|---|---|
| 3,435,456 | 3/1969 | Robb, Jr. | 343/702 |
| 5,132,696 | 7/1992 | Cobb | 343/709 |
| 5,218,370 | 6/1993 | Blaese | 343/702 |

FOREIGN PATENT DOCUMENTS

| | | | |
|---|---|---|---|
| 0508299 | 10/1992 | European Pat. Off. | H01Q 1/24 |
| 58-101506 | 6/1983 | Japan | 343/DIG. 1 |
| 61-20402 | 1/1986 | Japan | H01Q 1/18 |
| 61-61505 | 3/1986 | Japan | H01Q 1/18 |
| 62-71307 | 4/1987 | Japan | H01Q 1/18 |
| 0072702 | 3/1990 | Japan | H01Q 1/32 |
| 5055817 | 3/1993 | Japan | H01Q 1/24 |
| 220352 | 8/1924 | United Kingdom | 343/702 |

*Primary Examiner*—Donald T. Hajec
*Assistant Examiner*—Hoanganh Le

[57] ABSTRACT

A pole antenna of a hand-held, portable communication device, such as a cellular telephone, is maintained in a substantially vertical orientation. An antenna mast provides a support structure for the antenna. A pivot pin couples a medial portion of the antenna mast to a housing of the communication device. The pivot pin allows movement of the antenna mast about an axis of rotation. A weight is fixedly attached to the lower end of the antenna mast. The action of gravity acting on the weight maintains the antenna mast in a substantially vertical orientation as the housing of the communication device is tilted at an angle.

3 Claims, 1 Drawing Sheet

APPARATUS FOR MAINTAINING ANTENNA POLARIZATION IN PORTABLE COMMUNICATION DEVICES

BACKGROUND OF THE INVENTION

1. Field of the Invention

This invention relates generally to the field of telecommunications. More specifically, the invention relates to an apparatus for maintaining antenna polarization in a cellular telephone handset.

2. Related Art

In existing cellular telephone networks, signals in the 900 MHz frequency band are communicated between a base station and a portable telephone. The base station antenna transmits vertically polarized signals. The portable units use simple pole (i.e., monopole or dipole) antennas.

In order to maximize the signal level received by a portable unit, it is desirable to maintain the antenna of the portable unit in a vertical orientation. Unfortunately, most commercially available portable units have a fixed antenna generally oriented to align with the long axis of the unit. When the portable unit is held in alignment with the mouth and ear of a user, this generally orients the unit at approximately a 45° angle with respect to vertical. This results in a polarization mismatch with the vertically polarized signals being received from the base station. This polarization mismatch results in a loss in received signal power. For example, at a 45° angle from vertical, the received signal will have an amplitude 3 dB [i.e., 20log(cos 45°)] lower than that received by a vertically oriented antenna.

What is needed is a means for assuring a substantially vertical antenna orientation in portable units so that signal attenuation resulting from polarization mismatches can be minimized.

SUMMARY OF THE INVENTION

The invention is an apparatus for maintaining the antenna of a hand-held, portable communication device (portable unit) in a substantially vertical orientation. An antenna mast provides a protective or support structure for the active antenna element. A pivot means couples a medial portion of the antenna mast to a housing of the portable unit. The pivot means allows movement of the antenna mast about an axis of rotation. A weight is fixedly attached to the lower end of the antenna mast. The action of gravity acting on the weight maintains the antenna mast in a substantially vertical orientation.

In the preferred embodiment, a weight is added to the lower end of the antenna mast. In an alternate embodiment, the antenna mast may be configured so that the lower end of the antenna mast (i.e., the end below the point where the pivot means couples to the antenna mast) is substantially heavier than the upper end of the antenna mast (i.e., the end above the point where the pivot means couples to the antenna mast). This will allow the antenna to maintain a vertical orientation without the addition of an additional weight.

The foregoing and other objects, features and advantages of the invention will be apparent from the following, more particular description of a preferred embodiment to the invention, as illustrated in the accompanying drawings.

DETAILED DESCRIPTION OF THE PREFERRED EMBODIMENTS

The preferred embodiment of the invention is discussed in detail below. While specific configurations and arrangements are discussed, it should be understood that this is done for illustration purposes only. A person skilled in the art will recognize that other configurations and arrangements may be used without departing from the spirit and scope of the invention.

The preferred embodiment of the invention is now described with reference to the figures where like reference numbers indicate like elements. Also in the figures, the left most digit of each reference number corresponds to the figure in which the reference number is first used.

Figure 1:
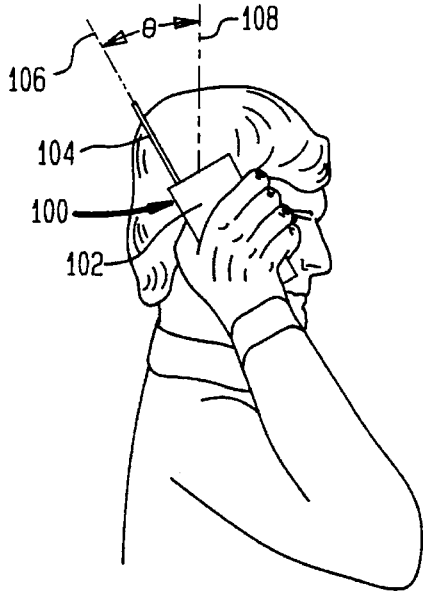
FIG. 1 is a diagram illustrating conventional use of a portable unit and the orientation of the antenna during such use.

FIG. 1 illustrates a user of a portable unit (e.g., a portable, cellular telephone) 100. Portable unit 100 includes a body or housing 102 and an antenna 104. Antenna 104 is a pole (i.e., a monopole or a dipole) antenna. Antenna 104 is fixed to body 102 to substantially align with a longitudinal axis 106 of body 102. In order for the user to properly align the microphone portion of portable unit 102 with his or her mouth and to align the speaker portion of portable unit 102 with his or her ear, the portable unit 102 must be tilted from a vertical axis 108. Note the angle θ formed between vertical axis 108 and axis 106 of antenna 104.

Conventional cellular networks communicate using vertically polarized signals. Vertically polarized electromagnetic energy received by antenna 104 will be attenuated as a function of angle θ. For example, during normal use of portable unit 102, it is common for angle θ to equal 45°. At 45°, the vertically polarized signal received by antenna 104 will be attenuated by 3 dB [i.e., 20 log(cos 45°)]. By maintaining antenna 104 in a substantially vertical orientation, this signal attenuation may be eliminated.

Figure 2:
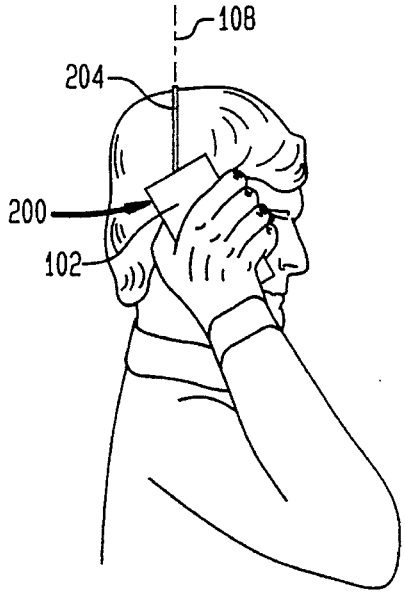
FIG. 2 is a diagram illustrating use of a portable unit constructed in accordance with the invention and the orientation of the antenna during such use.

The portable unit 200 of the invention is illustrated in FIG. 2. Similar to portable unit 100, portable unit 200 includes a body portion 102 and an antenna 204. Note, however, that while body portion 102 is maintained at an angle from vertical, antenna 204 is maintained in a substantially vertical orientation parallel to vertical axis 108. Antenna 204 is maintained in this vertical orientation regardless of the angular orientation of body portion 102 (within a reasonable range, as discussed below).

Figure 3:
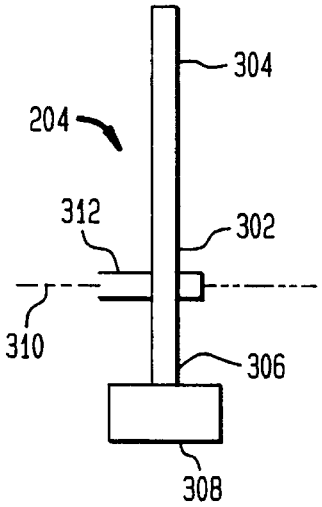
FIG. 3 is a diagram illustrating the components of the antenna of the invention.

The means by which antenna 204 maintains its vertical orientation is illustrated in FIG. 3. Antenna 204 includes an elongated antenna mast 302 having a first end 304 and a second end 306. Antenna mast 302 is a protective or support structure tier the actual active antenna element (not shown) which is normally a wire. In some cases, antenna mast 302 may also act as the active antenna element.

Antenna mast 302 is rotatably coupled to housing 102 via a pivot pin 312 for rotation about an axis 310. A weight 308 is coupled to end 306 of antenna mast 302. The force of gravity acting on weight 308 creates a moment of force (torque) on antenna mast 302 if mast 302 is not positioned in a vertical orientation. Thus, antenna mast 302 is maintained in a substantially vertical orientation.

Figure 4:
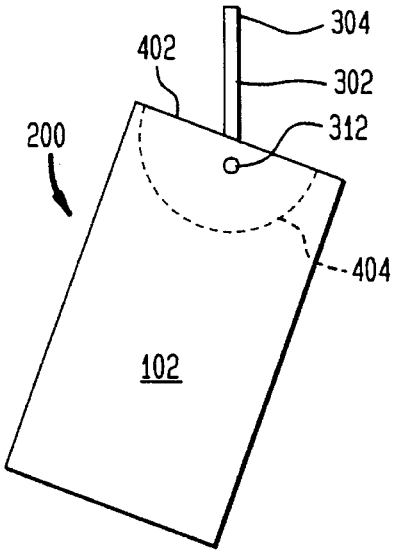
FIG. 4 is a front view of the portable unit of the invention.

FIG. 4 illustrates an embodiment on the invention in which antenna 204 is integrated into housing 102 of portable unit 200. Note that pivot pin 312 is oriented such that axis 310 is perpendicular to the drawing sheet. Antenna mast 302 extends out from an opening (not shown) in the top end 402 of housing 102. Dashed line 404 indicates an arc through which weight 308 will sweep as antenna mast 302 is rotated about axis 310. The area through which weight 302 sweeps must be maintained free of obstruction to allow free rotation of antenna mast 302 about axis 310.

Figure 5:
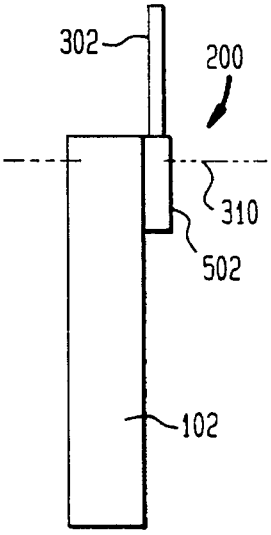
FIG. 5 is a side view of the portable unit of the invention.

FIG. 5 illustrates an embodiment of the invention in which antenna 204 is disposed in an antenna housing 502. Antenna housing 502 is attached to the outside of housing 102, opposite the side of portable unit 200 which interfaces with a user's mouth and ear. Antenna housing 502 provides a chamber through which weight 308 may rotate without interference from any electronic circuitry or other components within housing 102 of portable unit 200.

The angle through which body 102 of portable unit 200 may be rotated without adversely affecting the vertical orientation of antenna 204 will depend on the specific implementation of antenna 204. For example, the placement of pivot pin 312, the dimensions of antenna mast 302 and weight 308, and the opening in body 102 through which antenna mast 302 protrudes will all affect the tilt range of body 102 for which antenna 204 can compensate. A reasonable angle may be, for example, in the range of ±60°. That is, if the antenna is maintained vertical and the body is rotated about pivot pin 312, then the body may be rotated 60° from vertical in either the clockwise or the counterclockwise directions.

The invention has been thus far described in the environment of a vertically polarized communication system. The invention, however, may be used to maintain an antenna at any orientation including horizontal. For example, if it is desired to maintain an antenna in a horizontal orientation, the antenna mast may be configured in a "T" shape. The vertical portion of the T is then connected to pivot pin 312 as described above. The horizontal portion of the T houses the active antenna element. For other orientations, the horizontal portion of the T may be angled with respect to the vertical portion of the T.

Further, the invention has been described as allowing free movement of antenna 204 about a single axis. However, a gimbaled or similar arrangement may be used to provide movement of antenna 204 about two axes. These and other modifications of the invention will be apparent to one skilled in the art and are intended to be within the scope of the appended claims.

An advantage of the invention is that maintaining the polarization orientation of an antenna will improve receiver performance.

Another advantage of the invention is that maintaining the antenna at true vertical will minimize the amount of cross-polarization cancellation needed in the receiver. This advantage may have particular application in a cell implemented with dual polarization operation. Such a system is briefly described below.

Recent technological advances have reduced the price of cellular telephones. As a result, the number of cellular telephones in use has dramatically increased. Recent technological advances have also increased the capacity of cells (i.e., base stations). A typical macro-cell can accommodate as many as 40 to 60 users using frequency division multiple access (FDMA). The service area of the cell may have a radius of up to seven miles. The inventors contemplate that the capacity of such a cell may be doubled by implementing a dual polarization operation, wherein two separate signals are sent in the same frequency band, but with different polarizations (e.g., one signal with a vertical polarization and one signal with a horizontal polarization).

In such a system, the present invention would find particular application in discriminating between the different polarizations being used. The invention would help to minimize cross-coupling between polarizations while maximizing co-coupling between the polarized signal of interest.

Although the invention has been described and illustrated with a certain degree of particularity, it is understood that one skilled in the relevant art will recognize a variety of additional applications and appropriate modifications within the spirit of the invention and scope of the claims.

What is claimed is:

1. An antenna for a portable communication device, comprising: a pole antenna element;

an antenna mast providing a support structure for said pole antenna element and having a first end and a second end with a pivot point disposed therebetween, said second end having a weight greater than that of said first end; and pivot means for coupling said antenna mast to a housing of the portable communication device at said pivot point and for allowing movement of said antenna mast about said pivot point so that said antenna mast is positioned by the action of gravity in a substantially vertical orientation with said first end above said second end.

2. An apparatus for maintaining a pole antenna of a hand-held, portable communication device in a substantially vertical orientation, comprising:

an antenna mast providing a support structure for the pole antenna;

a pivot pin coupling a medial portion of said antenna mast to a housing of the portable communication device; and a weight fixedly attached to one end of said antenna mast, whereby said antenna mast is maintained in a substantially vertical orientation by the action of gravity acting on said weight.

3. An antenna assembly for a hand-held cellular telephone, comprising:

an antenna mast providing a support structure for a pole antenna;

pivot means defining an axis of rotation for coupling a medial portion of said antenna mast to a housing of the cellular telephone so that a first end of the antenna extends out from said housing and a second end of the antenna extends into said housing, and for allowing movement of said antenna mast relative to said housing about said axis of rotation;

a weight fixedly attached to said second end of said antenna mast, whereby said antenna mast is maintained in a substantially vertical orientation by the action of gravity acting on said weight.

* * * * *